United States Patent [19]

Bischoff

[11] Patent Number: 4,465,433

[45] Date of Patent: Aug. 14, 1984

[54] FLOW DUCT STRUCTURE FOR REDUCING SECONDARY FLOW LOSSES IN A BLADED FLOW DUCT

[75] Inventor: Hans Bischoff, Groebenzell, Fed. Rep. of Germany

[73] Assignee: MTU Motoren- und Turbinen-Union Muenchen GmbH, Munich, Fed. Rep. of Germany

[21] Appl. No.: 458,654

[22] Filed: Jan. 17, 1983

[30] Foreign Application Priority Data

Jan. 29, 1982 [DE] Fed. Rep. of Germany ..... 3202855

[51] Int. Cl.[3] ..... F01D 5/02

[52] U.S. Cl. ..... 416/223 A; 415/DIG. 1; 415/181; 416/193 A; 416/244 A

[58] Field of Search ..... 415/181, DIG. 1; 416/223 A, 244 A, 234 A, 193 A

[56] References Cited

U.S. PATENT DOCUMENTS

| | | | |
|---|---|---|---|
| 2,735,612 | 2/1956 | Hausmann | 415/DIG. 1 X |
| 2,918,254 | 12/1959 | Hausammann | 415/181 X |
| 2,920,864 | 1/1960 | Lee | 416/223 A X |
| 3,529,631 | 9/1970 | Riollet | 415/DIG. 1 X |
| 4,135,857 | 1/1979 | Pannone et al. | 416/234 A X |
| 4,208,167 | 6/1980 | Yasugahira et al. | 415/DIG. 1 X |
| 4,420,288 | 12/1983 | Bischoff | 415/DIG. 1 X |

FOREIGN PATENT DOCUMENTS

| | | | |
|---|---|---|---|
| 54808 | 5/1977 | Japan | 415/181 |
| 67404 | 6/1977 | Japan | 415/181 |
| 88901 | 7/1981 | Japan | 416/223 A |
| 252702 | 8/1927 | United Kingdom | 415/181 |
| 944166 | 12/1963 | United Kingdom . | |
| 1132259 | 10/1968 | United Kingdom . | |

*Primary Examiner*—Everette A. Powell, Jr.

*Attorney, Agent, or Firm*—W. G. Fasse; D. H. Kane, Jr.

[57] ABSTRACT

A bladed flow duct, for example in an axial flow turbo engine, is defined between two adjacent blades and the respective duct floor. In order to reduce secondary flow losses, the flow duct is provided with an arched zone (13, 13') projecting from the duct floor (10, 10') and extending along a portion of the suction side of the adjacent blade wall for producing a pressure rise or a reduction in the transverse pressure gradient over a relatively long forward and/or central portion of the duct as viewed in the flow direction (17) from the entrance end (21) to the exit end (22) of the duct. For this purpose the arched zone (13, 13') has a number of sections in the flow direction (17). A first section (23) starting in the entrance side of the duct is substantially or completely concave for causing said pressure rise. A second or central section (24) forms a convex peak and particularly a duct throat near the exit side of the duct. A third section (25) slopes down to the exit end (22). The sections (23, 24, 25) fall off or drop continuously or smoothly in the direction (16) across the flow direction (17) from the suction side of a blade (11)toward the pressure side of the respective opposite blade (12) but spaced from the opposite blade. This teaching is equally useful in rotor wheels as well as in stator guide rings.

12 Claims, 9 Drawing Figures

FIG. 2
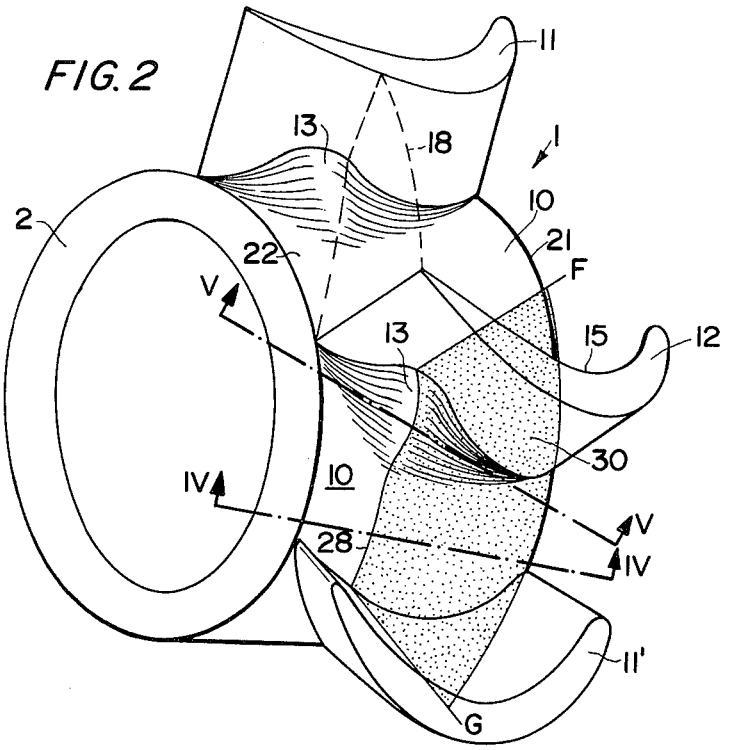
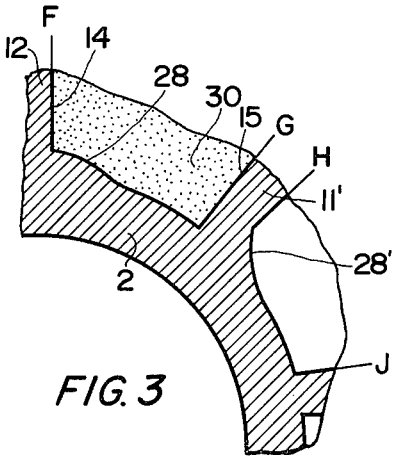
FIG. 3
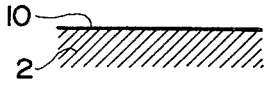
FIG. 4
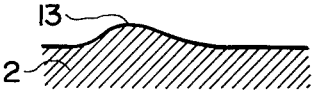
FIG. 5

FLOW DUCT STRUCTURE FOR REDUCING SECONDARY FLOW LOSSES IN A BLADED FLOW DUCT

CLAIM TO PRIORITY

The present application is based on German Ser. No. P 3,202,855.5-13, filed in the Federal Republic of Germany on Jan. 29, 1982. The priority of the German application is claimed for the present application.

BACKGROUND OF THE INVENTION

The invention relates to a flow duct structure for reducing secondary flow losses in a bladed flow duct for example, in a fluid flow engine such as a turbo engine.

British Pat. (GB-PS) No. 1,132,259 discloses a system of this type in which a flow channel has a flow cross-sectional area which becomes narrower in the flow direction from the entrance end toward a duct throat located in the exit side or in the rear half of the duct. The duct is provided with an arched zone in the form of a longitudinally extending depression including a down slope in the direction across the flow direction toward the suction side of a blade. This type of arched depression provides an increase in the flow cross-sectional area which increases the static pressure whereby the difference of the static pressures between the blade pressure side and the blade suction side of the duct is reduced. Stated differently, such a depression reduces the transverse pressure gradient in the direction across the flow direction, that is in the circumferential direction.

It has been found that secondary flow losses or so-called wall losses or eddies in the duct are caused by the fact, among other causes, that the boundary layer formation at the suction side of a blade is increased. Such increase in turn appears to be due to the fact that the boundary layer entering into the duct and the boundary layer being generated along the duct walls in the form of a frictional layer along the walls is driven by the transverse pressure gradient and reaches the blade suction side in the form of a cross flow or secondary flow which extends at a slant relative to the primary flow. The just mentioned resulting boundary eddies strongly affect the quality of the energy transformation, especially in connection with blades having a low aspect ratio which is the blade span or length divided by the chordal width. These boundary eddies or secondary flow losses are reduced by the above mentioned reduction in the transverse pressure gradient.

However, the above mentioned arched zone in the form of a depression is disadvantageous because its down slope is convex from the duct entrance to the maximum or rather to the deepest depression area located in the zone of the above mentioned rear throat. Thus, fluid flowing from the duct entrance to the duct throat is accelerated in addition to its normal acceleration. Accordingly, the pressure increase achieved by the arched depression is limited essentially to the throat zone in which the flow speed is decreased due to the increase of the flow cross-sectional area caused by the lowest zone of the arched depression and by the concave curve of the depression. On the other hand an increased pressure drop occurs along the zone of the mentioned amplified acceleration, whereby the respective transverse pressure gradient is increased. Accordingly, the mentioned decrease in the transverse pressure gradient is achieved substantially only in the zone or area of the duct throat which zone is relatively short and besides is located in the rear half of the duct. Accordingly, only a relatively small reduction of the secondary flow eddies or secondary losses is achieved. Another disadvantage of the arched depression is seen in that in most instances the depth of the depression cannot be made to such an extent as would be desirable due to the given structural facts of the respective engine, particularly since the blade platforms or blade carriers do not have the sufficient thickness required for this purpose.

British Pat. No. 944,166 discloses a turbo engine rotor having a circumferential surface which is partially arched outwardly between two axial flow blades. This arched portion extends primarily in the pressure side zone of the blades and in the downstream direction the depression merges gradually into an inwardly arched or depressed contour relative to a cylindrically extending circumferential surface of the duct bottom or duct floor.

OBJECTS OF THE INVENTION

In view of the above it is the aim of the invention to achieve the following objects singly or in combination:

to cause a pressure increase in the channel wall zone along the blade suction side and over a longer area that extends toward the forward or entrance end of the duct;

to provide means for reducing secondary losses which are equally useful in axial flow turbo engines as well as in axial flow turbines and also in radial flow turbo engines as well as in rotors and/or stator rings; and to locate the arched depression so that the depth of its concave section is not dependent on the thickness of the blade carrier or platform.

SUMMARY OF THE INVENTION

The flow duct structure for reducing secondary flow losses in a bladed flow duct has an arched zone extending along at least one of two duct walls between two circumferentially adjacent blades, whereby the arched zone extends along the suction side of the adjacent blade and at a distance from the pressure side of the opposite blade with the maximum area located in the rear or downstream portion of the duct. The arched zone has a continuous downward slope in the direction extending across the flow direction, namely in the chordwise direction. Such an arched zone is characterized according to the invention in that it rises in an essentially or completely concave curve in the flow direction through the duct until it reaches its maximum, and in that the chordwise drop or slope of the arched zone starts at the suction side of the adjacent blade.

Thus, according to the invention the arched zone extends above the flow channel in the form of a raised zone ascending in the flow direction through the duct until it reaches the maximum area whereby at least a substantial portion of the rise is concave, whereby the streamlines have a positive curvature and so that centrifugal forces occur in a direction normal to the streamlines, whereby such centrifugal forces are taken up by pressure increases. The pressure increase may start already shortly downstream of the beginning of the concave ascent. The invention achieves a pressure increase or a reduction in the transverse pressure gradient and thus a reduction in the slanted cross flow in a larger area than was possible heretofore, namely in the channel wall zone along the suction side of the adjacent blade over a relatively long forward and/or central area. Thus, a substantial reduction of the mentioned secondary flow eddies or secondary losses is achieved according to the invention. The area or zone downstream of the ascent of the arched zone is of relatively little significance. However, the pressure in that area or zone is also rather high as a result of the increased pressure upstream thereof in the arched zone. Another advantage of the invention is seen in that the arched zone may rise above the duct floor to any desired extent.

The arched zone has normally three sections of which the first section in the form of a complete or substantially complete concave rise is followed by a convex section in the maximum area which in turn is followed by a concave downward slope. These sections extend in the flow direction through the flow duct and the downward slope may, for example, be straight or convex, whereby the described advantages are also achieved. Preferably, the concave or substantially concave first section rise extends all the way to the duct throat or even to a point downstream of the duct throat. In this instance with the first section rising to the duct throat a special pressure pattern may be achieved within the duct by a suitable selection of the longitudinal or curved contour of the concave rise section of the arched zone. Such pressure pattern may convert the deceleration normally occurring downstream of the duct throat into an acceleration. Thus, the fluid which is accelerated less as it travels toward the duct throat due to the concave rise, than is the case in a conventional duct, is further accelerated. Stated differently, in a duct according to the invention the fluid flow is continuously accelerated from the entrance to the exit side or area of the flow duct. Thus, the losses which are present in prior art structures due to the just mentioned deceleration are reduced according to the invention, whereby the efficiency is additionally improved. This just mentioned improvement is in addition to the improvement achieved in the efficiency due to the reduction in the secondary flow losses.

The effects and advantages of the invention are also enhanced by the pressure rise which begins already in the upstream or entrance side of the flow duct or even directly at the entrance while the arched zone preferably ends in the exit side of the duct in the form of the above mentioned third section having a longitudinal downslope. The descent in the cross direction may preferably have an S-shape or it may be a straight line descent or a concave descent. Further, the descent in the cross direction may change its shape in the longitudinal flow direction.

BRIEF FIGURE DESCRIPTION

In order that the invention may be clearly understood, it will now be described, by way of example, with reference to the accompanying drawings, wherein:

FIG. 2 is a perspective view similar to that of FIG. 1 and showing three blades while omitting the others to simplify the illustration;

FIG. 4 is a sectional view along section line IV—IV in FIG. 2;

DETAILED DESCRIPTION OF PREFERRED EXAMPLE EMBODIMENTS AND OF THE BEST MODE OF THE INVENTION

Figure 1:
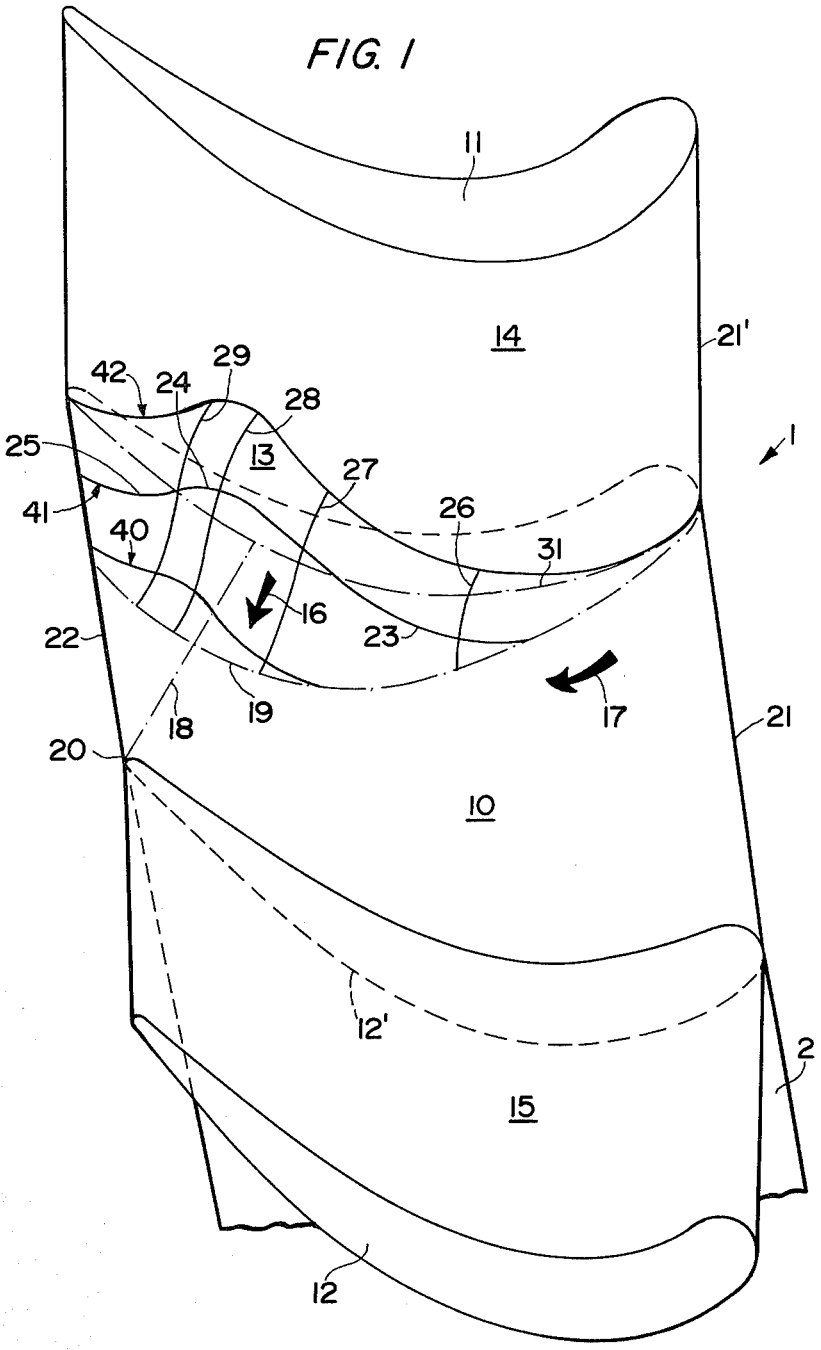
FIG. 1 is a projected side view of a portion of an axial flow wheel according to the invention showing two blades and a portion of the blade platform or carrier.

In FIG. 1 an axial flow duct 1 is formed by the blade carrier or platform 2 which provides a floor 10 for the flow duct 1 which is laterally bounded by two adjacent blades 11 and 12 or more specifically, by the suction side 14 of the blade 11 and by the pressure side 15 of the blade 12. The flow direction 17 extends axially from the entrance 21 to the exit 22 of the flow duct 1. The area adjacent to the entrance 21 will be referred to as the entrance side and the area adjacent to the exit 22 will be referred to as the exit side. The floor or bottom 10 is normally cylindrical except for the outwardly arching zone 13 provided according to the invention. The relative height of the arched zone 13 in the radial direction is exaggerated in the illustration in order to provide a clear representation of the invention.

For comparing the invention with the prior art, no arched zone 13 is shown below the lower blade 12. Thus, the suction side of the lower blade 12 in FIG. 1 facing downwardly intersects the blade carrier 2 along the dashed line 12'. The arched portion 13 according to the invention extends along the suction side 14 of the upper blade 11 and at a distance from the pressure side 15 of the opposite lower blade 12. The arched portion 13 drops transversely, that is in the direction of the arrow 16 extending substantially across the flow direction 17 from the suction side 14 toward the pressure side 15, thereby forming an S-configuration as indicated by the four transverse outer contour lines 26, 27, 28, and 29. For example, the transverse drop indicated by these lines is first convex adjacent to the suction side 14 and then turns into a concave shape further away from the suction side 14. This type of contour applies essentially to any area of the arched zone 13 in the transverse direction.

The duct between the two blades 11 and 12 narrows continuously from the entrance 21 to the duct throat indicated by a dash-dotted line 18. The cross-sectional flow area of the throat 18 extends approximately perpendicularly to the surface of the suction side 14 of the blade 11 and is defined at the lower end of FIG. 1 by the trailing edge 20 of the lower blade 12 of the pair of blades 11, 12. This throat 18 is located in the downstream half portion of the duct 1 near the exit side.

The form or shape of the surface of the arched zone 13 in the flow direction 17 is indicated by three longitudinal outer contour lines 40, 41 and 42 extending substantially in the flow direction 17. Each of these longitudinal flow lines has three sections 23, 24 and 25 shown only for the contour line 41 for simplicity's sake. The first section 23 of the arched zone 13 begins near the suction side 14 of the blade 11 slightly downstream of the entrance 21 as viewed in the flow direction. The section 23 rises above the duct floor or bottom 10, but has a concave shape which merges into the second section 24 having a convex shape which in turn merges into the third section 25 having a straight or concave downward slope. The beginning of the first sections 23 toward the entrance 21 is marked by the dash-dotted line 19. The second section 24 denoting the peak of the arched zone 13 is located substantially in the area of the duct throat 18. As shown, the peak is located between the lateral or transverse contour lines 27 and 29.

The arched zone 13 has its widest extent in the transverse direction 16 in the area of the duct throat 18. Incidentally, the dash-dotted line 19 marking the beginning of the first sections 23 extends approximately from the leading edge 21' of the blade 11 to about the center of the exit 22. Along this contour as marked by the dash-dotted line 19 the transition of the arched zone 13 into the cylindrical duct bottom 10 is continuous. The transition between the suction side 14 of the blade 11 and the arched zone 13 will include an apex. However, small radii of curvature are acceptable in this transition area between 14 and 13.

To simplify the illustration of FIG. 2, only three rotor blades 11, 12 and 11' are shown, whereby the blade size is considerably exaggerated relative to the circumference of the blade carrier 2 of the rotor. The same reference numbers are used in FIG. 2 as in FIG. 1 for the corresponding elements. The shown flow lines are to indicate the location and contours of the arched zone 13 relative to the floor 10 of each duct 1. However, no such zone 13 is shown below the blade 11' so as not to make the illustration too complicated. The throat area is again shown by the dashed line 18 between the blades 11 and 12. A similar zone is provided between the blades 12 and 11' and so forth. In the embodiment of FIG. 2 the duct throat 18 is located upstream of the peak of the arched zone 13.

Figure 3A:
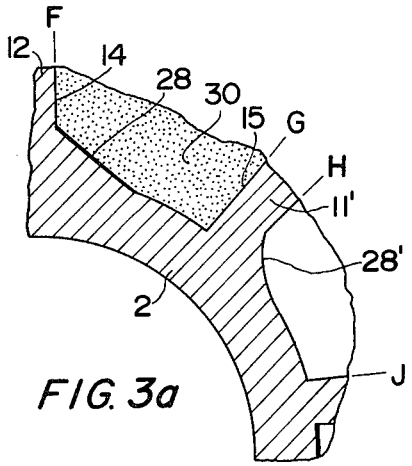
FIG. 3 is a sectional view through FIG. 2, along a radial plane defined by the radial lines F and G, whereby the respective sectional plane is indicated by a dotted area.
Figure 3B:
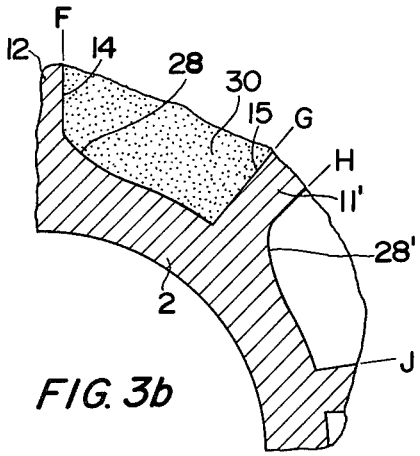

The radially extending lines F and G shown in FIG. 2 enclose a radially extending plane 30 also shown in the sectional view in FIG. 3. The plane 30 is indicated by dots so as to facilitate the illustration. The sectional view of FIG. 3 shows the transverse contour line 28 resulting from the intersection of the normal plane 30 with the circumferential surface or bottom 10 of the blade carrier 2. This transverse contour line 28 shows a convex arched portion which forms an apex with the suction side 14 of the blade 12. On the other hand, the contour line 28 forms a continuously concave transition relative to the circumferential cylindrical surface of the rotor 2 forming the bottom or floor 10 of the duct 1. In an alternative embodiment the contour 28 may be concave along its entire length if there is no break point or line over its length in the transversed direction. Such a contour line with a continuous concave slope is shown at 28' in FIG. 3 between the radial lines H and J.

Figure 5A:
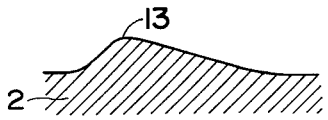
FIG. 5 is a sectional view along section line V—V in FIG. 2.

FIG. 4 shows the simplified surface of the cylindrical duct bottom 10 outside the arched zone 13. FIG. 5 shows the same sectional view, but within the arched zone 13.

Figure 6:
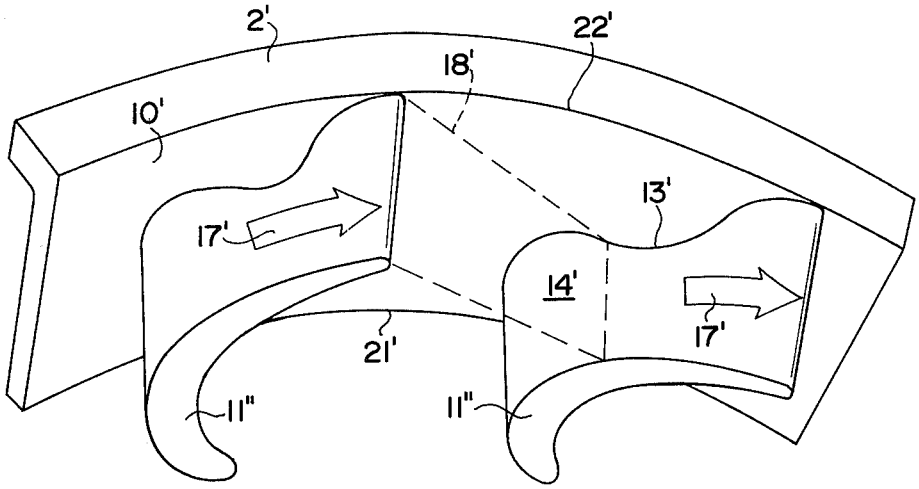
FIG. 6 is a perspective view of a portion of a stator guide ring or cascade with axial flow blades, the inner circumferential surface of which is formed in accordance with the present invention.

FIG. 6 shows a perspective view of a stator cascade or rather a portion thereof, whereby the same elements are provided with the same reference numbers, except that the reference numbers are provided with a prime. The carrier 2' is not the rotor hub, but rather a portion of the stator carrying the blades 11''. FIG. 6 shows that the invention is also applicable to the guide vanes of a stator ring.

The illustrations show turbo engine components having an axial flow direction. However, the invention is equally applicable to such engine components having a radial flow direction, whereby in each instance the invention may also be used in the rotor and/or in the stator.

Although the invention has been described with reference to specific example embodiments, it will be appreciated, that it is intended to cover all modifications and equivalents within the scope of the appended claims.

What is claimed is:

1. In a flow duct of a fluid flow engine having a plurality of blades supported by a blade carrier on which the blades are circumferentially spaced to form a flow duct defining a flow direction (17) between two adjacent blades forming a pair, whereby the blade carrier forms a duct floor, and wherein an arched zone is located in the flow duct, said arched zone extending along the suction side of an adjacent blade and spaced from the pressure side of the opposite blade of a pair thereby having a continuous drop toward the pressure side of the opposite blade of a pair in a direction (16) across the flow direction, the improvement wherein said arched zone (13, 13') comprises a first section (23) rising in a concave manner in the flow direction (17) and beginning in an entrance side of the respective duct, a second peak section (24) in an exit side of the duct and a falling third section (25) falling toward an exit (22) of the duct, said arching zone (13, 13') sloping down in the cross direction (16) beginning at the suction side of the adjacent blade (11).

2. The flow duct of claim 1, wherein said first rising section (23) is substantially concave along its length in the flow direction (17).

3. The flow duct of claim 1, wherein said first rising section (23) is entirely concave along its length in the flow direction (17).

4. The flow duct of claim 1, wherein said second peak section (24) is convex along the flow direction (17), and wherein the falling third section (25) is concave.

5. The flow duct of claim 1, wherein said duct has a throat (18) near its exit, said first section (23) of said arched zone (13, 13') extending at least to said throat (18), said peak section (24) being located in said throat section (18).

6. The flow duct of claim 5, wherein said first section (23) extends beyond said throat toward an exit (22) of said duct.

7. The flow duct of claim 1, wherein said first section (23) has a concave portion which is located in said entrance side of said duct.

8. The flow duct of claim 7, wherein said first section (23) has a straight portion located between said concave portion and said peak section (24).

9. The flow duct of claim 1, wherein said first section (23) has a concave portion which is located near the suction side (14) of the adjacent blade (11) and which begins in the entrance side of the duct.

10. The flow duct of claim 1, wherein said continuous drop toward the pressure side of the opposite blade of a pair of blades (11, 12) has an S-contour in said direction (16), said S-contour being convex near the suction side (14) of the adjacent blade (11) and concave toward the pressure side (15) of the opposite blade (12).

11. The flow duct of claim 1, wherein said continuous drop toward the pressure side (15) has a straight contour in said cross direction (16).

12. The flow duct of claim 1, wherein said continuous drop toward the pressure side (15) has a concave contour.

* * * * *